United States Patent [19]

Kitrell

[11] 4,294,268

[45] Oct. 13, 1981

[54] PEDICURE EASEL

[76] Inventor: John V. Kitrell, 4639 Holdrege, Lincoln, Nebr. 68503

[21] Appl. No.: 149,320

[22] Filed: May 13, 1980

[51] Int. Cl.[3] ..... A45D 29/00

[52] U.S. Cl. ..... 132/73

[58] Field of Search ..... 132/73, 73.5

[56] References Cited

U.S. PATENT DOCUMENTS

| | | | |
|---|---|---|---|
| D. 162,870 | 4/1951 | Pearce | 132/73 UX |
| 1,065,966 | 7/1913 | Pfanschmidt | 132/73.5 |
| 2,676,597 | 4/1954 | Colbert | 132/73 |

*Primary Examiner*—G. E. McNeill

*Attorney, Agent, or Firm*—Zarley, McKee, Thomte, Voorhees & Sease

[57] ABSTRACT

A pedicure easel is described including a first inverted U-shaped member which is adapted to be placed on a bathroom floor and extended upwardly therefrom. A second U-shaped supporting member is pivotally secured adjacent its forward end to the upper end of the first supporting member and is adapted to have its rearward end extended over the forward lip of a toilet bowl. A supporting foot plate is pivotally secured adjacent its rearward end to the second support member forwardly of the rearward end thereof and has its lower forward end detachably secured to the upper end of the first supporting member. The easel may be selectively folded from the position just described to a flat folded position. The foot plate has a central storage cavity formed therein adapted to receive an accessory tray which may be selectively secured to the opposite side edges of the foot plate during the use thereof.

9 Claims, 7 Drawing Figures

PEDICURE EASEL

BACKGROUND OF THE INVENTION

This invention relates to a pedicure easel and more particularly to a folding pedicure easel.

Many persons find it difficult to perform pedicure operations. The primary difficulty in performing the pedicure operations is the positioning of the foot during the trimming, filing, etc.

Therefore, it is a principal object of the invention to provide a pedicure easel.

A still further object of the invention is to provide a folding pedicure easel.

A still further object of the invention is to provide a pedicure easel which may be secured to a toilet bowl so that the person utilizing the easel may sit upon the toilet lid and position their foot on the easel.

A still further object of the invention is to provide a pedicure easel having an accessory tray associated therewith.

A still further object of the invention is to provide a pedicure easel which properly positions the foot for the pedicure operation.

A still further object of the invention is to provide a pedicure easel which is durable in use, refined in appearance and economical of manufacture.

SUMMARY OF THE INVENTION

Figure 1:
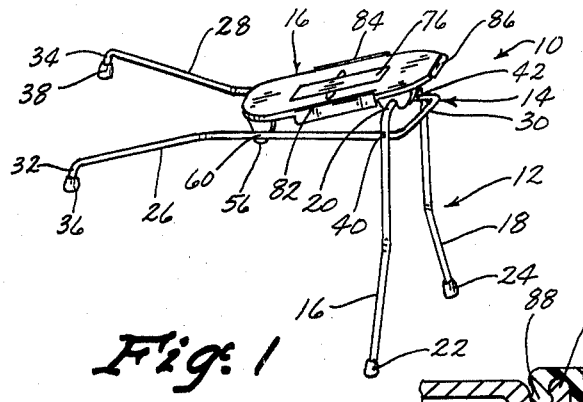
FIG. 1 is a perspective view illustrating the pedicure easel of this invention.

A folding pedicure easel is described including a pair of supports which are pivotally secured together. One of the supports has its lower end in engagement with the bathroom floor and extends upwardly therefrom. The second support is pivotally secured adjacent its forward end to the upper end of the first support. The rearward end of the second support is extended or positioned over the forward lip of a toilet bowl. A foot supporting plate is pivotally secured at its rearward end to the second support and has its lower forward end detachably secured to the upper end of the first support thereby maintaining the easel in its operative position.

DESCRIPTION OF THE PREFERRED EMBODIMENT

The pedicure easel of this invention is referred to generally by the reference numeral 10 and generally comprises supports 12 and 14 and foot plate 16. Support 12 generally defines an inverted U-shaped including legs 16 and 18 having an upper portion 20 extending therebetween. Preferably, the lower ends of legs 16 and 18 are provided with cups 22 and 24 respectively.

Support 14 also defines a U-shape including legs 26 and 28 having a forward end 30 extending therebetween as illustrated in the drawings. Legs 26 and 28 are provided with downwardly extending portions 32 and 34 respectively having cups 36 and 38 mounted thereon respectively. Support 14 is pivotally secured, adjacent its forward end, to support 12, adjacent the upper end thereof, by pins 40 and 42.

Foot plate 16 generally includes rearward end 44, forward end 46, opposite side edges 48 and 50, upper surface 52 and lower surface or end 54. The lower rearward end of foot plate 16 is provided with a pair of lugs or ears 56 and 58 which are pivotally secured to legs 26 and 28 respectively by pins 60 and 62. The lower forward end of foot plate 16 is provided with a pair of downwardly extending lugs 64 and 66 having U-shaped notches or openings 68 and 70 formed therein which are adapted to detachably receive the upper end 20 of support 12 as illustrated in the drawings.

Plate 16 is provided with a central storage cavity 72 formed therein adapted to receive the tool or accessory box 74 therein. The numeral 76 refers to a cover which is adapted to close the upper end of the cavity 72. The upper surface of plate 16 is provided with a pair of recesses 78 and 80 to enable the convenient removable of the cover 76 from the upper end of the cavity 72 as desired.

Foot plate 16 is provided with attachment portions 82 and 84 at its opposite sides and an attachment portion 86 at its forward end. As seen in the drawings, the box or tray 74 is provided with an attachment portion 88 at one side thereof which is adapted to be selectively secured to any one of the attachment portions 82, 84 or 86.

Figure 2:
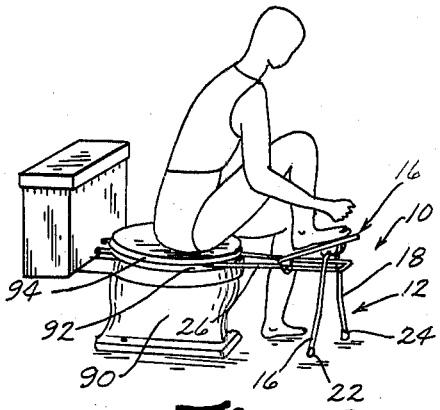
FIG. 2 is a perspective view illustrating the pedicure easel of this invention being used.
Figure 4:
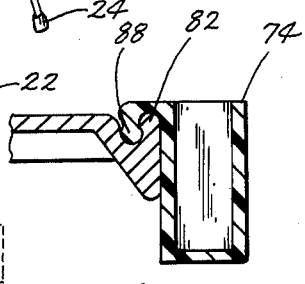
FIG. 4 is a sectional view seen on lines 4—4 of FIG. 3.

In use, the easel is positioned as illustrated in FIG. 1 so that the rearward end of the support 14 engages the upper forward lip of the toilet bowl 90. The seat 92 and cover 94 are lowered to their horizontal position over the legs 26 and 28 to maintain the easel in the position illustrated in FIG. 2. The engagement of the lower forward end of the foot plate 16 with the upper end of the support 12 maintains the easel in its operative position and presents an inclined foot supporting surface for the person to place their foot upon as illustrated in FIG. 2. The tool box or tray may be removed from the cavity 72 and placed on any of the attachment portions 82, 84 or 86 as required.

Figure 3:
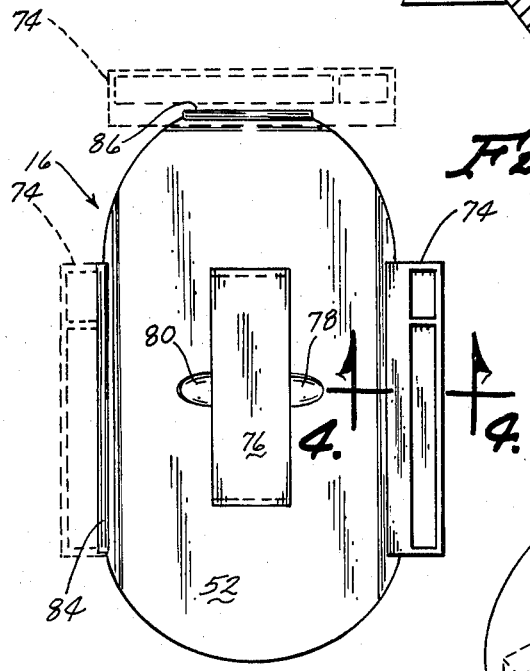
FIG. 3 is a partial top view of the pedicure easel with the broken lines illustrating the alternate positions of the storage box.
Figure 5:
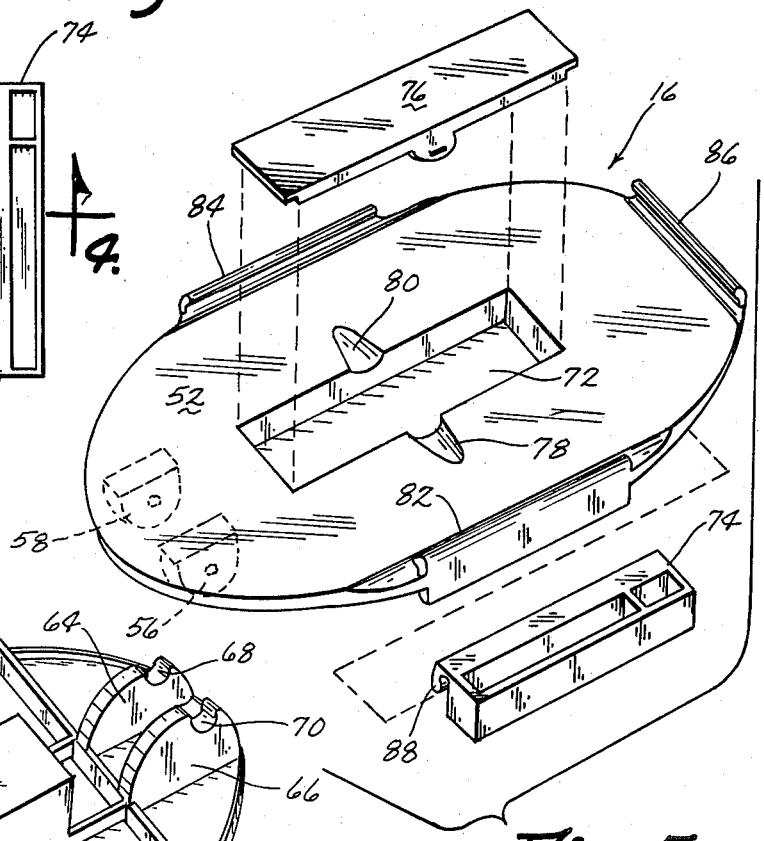
FIG. 5 is a partial exploded perspective view.
Figure 6:
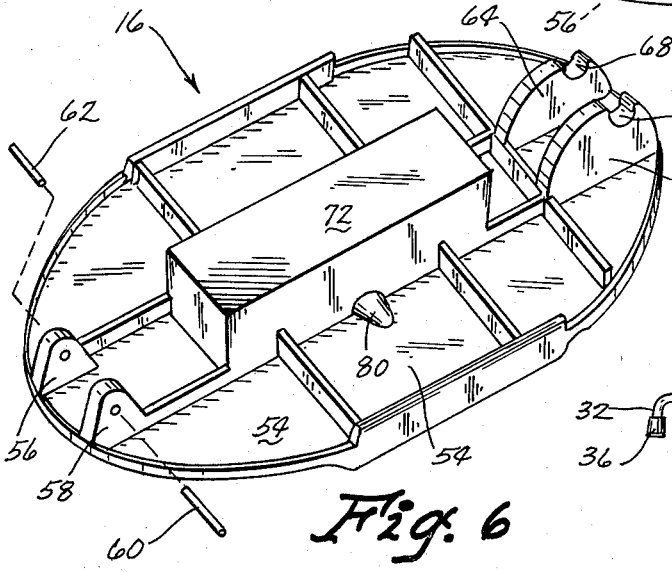
FIG. 6 is a bottom perspective view of the pedicure easel.
Figure 7:
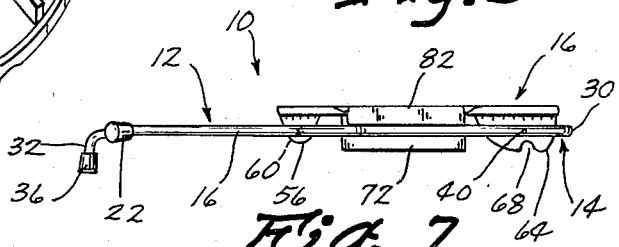
FIG. 7 is a side view of the pedicure easel in a folded condition.

After the use of the easel has been completed, the box 74 may be placed in the cavity 72 with the cover 76 positioned over the upper end thereof. The support 14 is removed from the engagement with the toilet bowl and the lower forward portion of the foot plate 16 is disconnected from the upper end of the support 12. Support 12 may then be folded to the folded position illustrated in FIG. 3 to enable the entire assembly to be conveniently stored.

Thus it can be seen that a novel pedicure easel has been provided which may be pivotally moved from a folded storage position to an operative position whereby the person may support his or her foot thereupon in a convenient manner. Thus it can be seen that the easel accomplishes at least all of its stated objectives.

I claim:

1. A pedicure easel, comprising, a supporting means comprising first and second support means, said first support means having a pair of ends, one end of said first support means being adapted to be placed on a horizontal supporting surface, said second support means having a pair of ends, said second support means being secured, adjacent one end thereof, to said first support means adjacent the said other end thereof, the other end of said second support means being adapted to be removably secured to a toilet bowl, and a foot supporting plate mounted on said supporting means.

2. The pedicure easel of claim 1 wherein said first support means comprises a substantially inverted U-shaped member.

3. The pedicure easel of claim 2 wherein said second support means comprises a substantially U-shaped member.

4. The pedicure easel of claim 1 wherein said first and second support means are selectively pivotally secured together and wherein said plate is selectively pivotally secured to said first and second support means to permit the easel to be selectively positioned in operative and folded conditions.

5. The pedicure easel of claim 1 wherein a tray means is removably mounted on said plate.

6. The pedicure easel of claim 1 wherein said plate has opposite side portions and wherein a tray means is removably mounted on either of said side portions.

7. The pedicure easel of claim 4 wherein said plate has a central storage cavity formed therein which receives said tray means at times.

8. The pedicure easel of claim 7 wherein a cover is removably secured to said plate which extends over said storage cavity.

9. A pedicure easel, comprising, a first inverted U-shaped support member having upper and lower ends, said lower end being adapted for engagement with a horizontal supporting surface, a second U-shaped support member having rearward and forward ends, said second support member being pivotally secured, adjacent its forward end, to said first support member below the upper end thereof, the rearward end of said second support member having means thereon for engagement with the upper end of a toilet bowl, a foot support plate having rearward and forward ends, and upper and lower surfaces, said plate being pivotally secured, at its rearward end, to said second support member forwardly of the rearward end thereof, said plate being selectively detachably secured, adjacent the lower forward end thereof, to the upper end of said first support member.

* * * * *